US011480172B2

(12) United States Patent
Yoshimura et al.

(10) Patent No.: US 11,480,172 B2
(45) Date of Patent: Oct. 25, 2022

(54) GEAR PUMP

(71) Applicant: TOYODA GOSEI CO., LTD., Kiyosu (JP)

(72) Inventors: Mitsuhiro Yoshimura, Kiyosu (JP); Shinya Sakai, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 17/011,365

(22) Filed: Sep. 3, 2020

(65) Prior Publication Data

US 2021/0095663 A1 Apr. 1, 2021

(30) Foreign Application Priority Data

Sep. 27, 2019 (JP) ..... JP2019-177954

(51) Int. Cl.
*F04C 2/08* (2006.01)
*F04C 2/10* (2006.01)
*F04C 15/00* (2006.01)

(52) U.S. Cl.
CPC ..... *F04C 2/102* (2013.01); *F04C 2/086* (2013.01); *F04C 15/0026* (2013.01);
(Continued)

(58) Field of Classification Search
CPC .. F04C 15/0026; F04C 15/00; F04C 15/0034; F04C 2230/60; F04C 2230/602;
(Continued)

(56) References Cited

U.S. PATENT DOCUMENTS 2,870,720 A * 1/1959 Lorenz ..... F04C 15/0026 418/78
9,810,215 B2 * 11/2017 Ishii ..... F04C 2/102
(Continued)

FOREIGN PATENT DOCUMENTS

DE 4326627 A1 2/1995
JP S58-63386 A 4/1983
(Continued)

OTHER PUBLICATIONS

Office Action dated Apr. 26, 2022 issued in corresponding Chinese Application No. 202011029770.0.
(Continued)

*Primary Examiner* — Audrey B. Walter
*Assistant Examiner* — Dapinder Singh
(74) *Attorney, Agent, or Firm* — Posz Law Group, PLC

(57) ABSTRACT

A gear pump includes: an inner rotor having external teeth; an outer rotor having a tubular inner housing portion in which the inner rotor is rotatably housed in an eccentric state, and internal teeth meshing with the external teeth; a first core having a tubular rotor housing portion in which the inner and outer rotors are housed, and a flange portion projecting radially outward from a tube wall of the rotor housing portion; a board-shaped second core having a contact portion in contact with the flange portion in an axial direction, and closing an opening of the rotor housing portion; and a housing opposing the second core and made of a resin. A gap is formed between opposing surfaces of the second core and the housing in a state where the flange portion is in contact with the contact portion and the housing opposes the second core.

7 Claims, 8 Drawing Sheets

(52) U.S. Cl.
CPC ..... *F04C 2230/60* (2013.01); *F04C 2240/30* (2013.01); *F05C 2253/20* (2013.01)

(58) Field of Classification Search
CPC .. F04C 2/102; F04C 2/086; F04C 2/10; F04C 2240/30; F04C 2240/20; F04C 2240/56; F04C 2240/805; F05C 2253/20; F01C 21/108
See application file for complete search history.

(56) References Cited

U.S. PATENT DOCUMENTS

| | | | | |
|---|---|---|---|---|
| 10,077,807 | B2 | 9/2018 | Ishii et al. | |
| 2015/0204325 | A1 | 7/2015 | Ishii et al. | |
| 2015/0204383 | A1 | 7/2015 | Ishii et al. | |
| 2018/0274539 | A1* | 9/2018 | Asada | F04C 2/102 |
| 2019/0242380 | A1* | 8/2019 | Ramadoss | F04C 15/008 |

FOREIGN PATENT DOCUMENTS

| | | | |
|---|---|---|---|
| JP | 2013-204646 | A | 10/2013 |
| JP | 2014-051964 | A | 3/2014 |
| JP | 2017-066976 | A | 4/2017 |
| JP | 2018-184956 | A | 11/2018 |

OTHER PUBLICATIONS

Notification of Reasons for Refusal dated Jul. 26, 2022 for corresponding Japanese Application No. 2019-177954 (and English Machine Translation).

* cited by examiner

GEAR PUMP

TECHNICAL FIELD

The present invention relates to a gear pump.

BACKGROUND ART

Hitherto, a trochoid type gear pump has been known (for example, JP2014-51964(A) and JP2017-66976(A)). The gear pump includes an inner rotor, an outer rotor, a housing, and a cover. The inner rotor is fixed to a drive shaft and has external teeth. The outer rotor has internal teeth that mesh with the external teeth of the inner rotor. The inner rotor is rotatable in a state where the inner rotor is eccentric to the outer rotor. The housing has a recess in which the inner rotor and the outer rotor are housed. The cover is disposed in an axial direction with respect to the housing and closes the opening of the recess of the housing.

In the gear pump disclosed in JP2014-51964(A), the inner rotor, the outer rotor, and the cover are each formed from a metal. In addition, at least a part of the housing is formed from an injection-molded resin. According to the structure of the gear pump, weight reduction is achieved as compared to a structure in which the entire housing is formed from a metal.

The gear pump disclosed in JP2017-66976(A) includes a metallic core having a rotor housing portion in which the inner rotor and the outer rotor are housed. The core is insert-molded in a housing made of a resin and is disposed in a recess of the housing. The rotor housing portion of the core and the recess of the housing are closed by a cover made of a metal. The cover made of a metal is fastened by a bolt in a state where the cover opposes the housing made of a resin.

SUMMARY OF INVENTION

Technical Problem

However, in the gear pump, unless the dimension of each component is appropriately managed, the following inconvenience arises. Specifically, if the dimension of each component is managed in a favorable manner, when the recess of the housing is closed by the cover, no undesired gaps are formed between the inner and outer rotors, and the cover, and thus desired accuracy in assembling is ensured. In this case, the effective capacity of a working chamber in which a liquid such as oil is retained is constant, and a stable discharge amount is ensured. On the other hand, if the dimension of each component is poorly managed, when the recess of the housing is closed by the cover, undesired gaps may be formed between the inner and outer rotors, and the cover, and thus the accuracy in assembling may decrease. If the accuracy in assembling is poor, the effective capacity of the working chamber in which a liquid such as oil is retained varies, and a stable discharge amount is not ensured.

Meanwhile, in order to appropriately manage the dimension of each component and further obtain a favorable state for a fastening force generated by assembling each component, forming each component from a metal and performing cutting on each component are considered. However, if each component is formed from a metal, the weight of the entire gear pump increases, and if cutting needs to be performed on each component, time and effort are taken in manufacturing.

The present invention has been made in view of such problems, and an object of the present invention is to provide a gear pump that ensures desired accuracy in assembling each component while achieving weight reduction.

Solution to Problem

An aspect of the present invention is directed to a gear pump including:

an inner rotor having external teeth;

an outer rotor having a tubular inner housing portion in which the inner rotor is rotatably housed in an eccentric state, and internal teeth that mesh with the external teeth;

a first core having a tubular rotor housing portion in which the inner rotor and the outer rotor are housed, and a flange portion projecting radially outward from a tube wall of the rotor housing portion;

a board-shaped second core having a contact portion that is in contact with the flange portion in an axial direction, and closing an opening of the rotor housing portion; and a housing disposed so as to oppose the second core and made of a resin, wherein a gap is formed between opposing surfaces of the second core and the housing in a state where the flange portion and the contact portion are in contact with each other and the housing is disposed so as to oppose the second core.

According to this configuration, a gap is formed between the opposing surfaces of the second core and the housing in a state where the flange portion of the first core and the contact portion of the second core are in contact with each other and the housing is disposed so as to oppose the second core. Therefore, contact between the second core and the housing is avoided even when the first core and the second core are in contact with each other, and thus the accuracy in positioning the first core and the second core relative to each other is enhanced. Furthermore, the housing is formed from a resin. Thus, the weight of the gear pump is reduced. Accordingly, desired accuracy in assembling each component is ensured while the weight of the gear pump is reduced.

DESCRIPTION OF EMBODIMENTS

Specific embodiments and modifications of the gear pump according to the present invention will be described with reference to FIG. 1 to FIG. 12.

Figure 1:
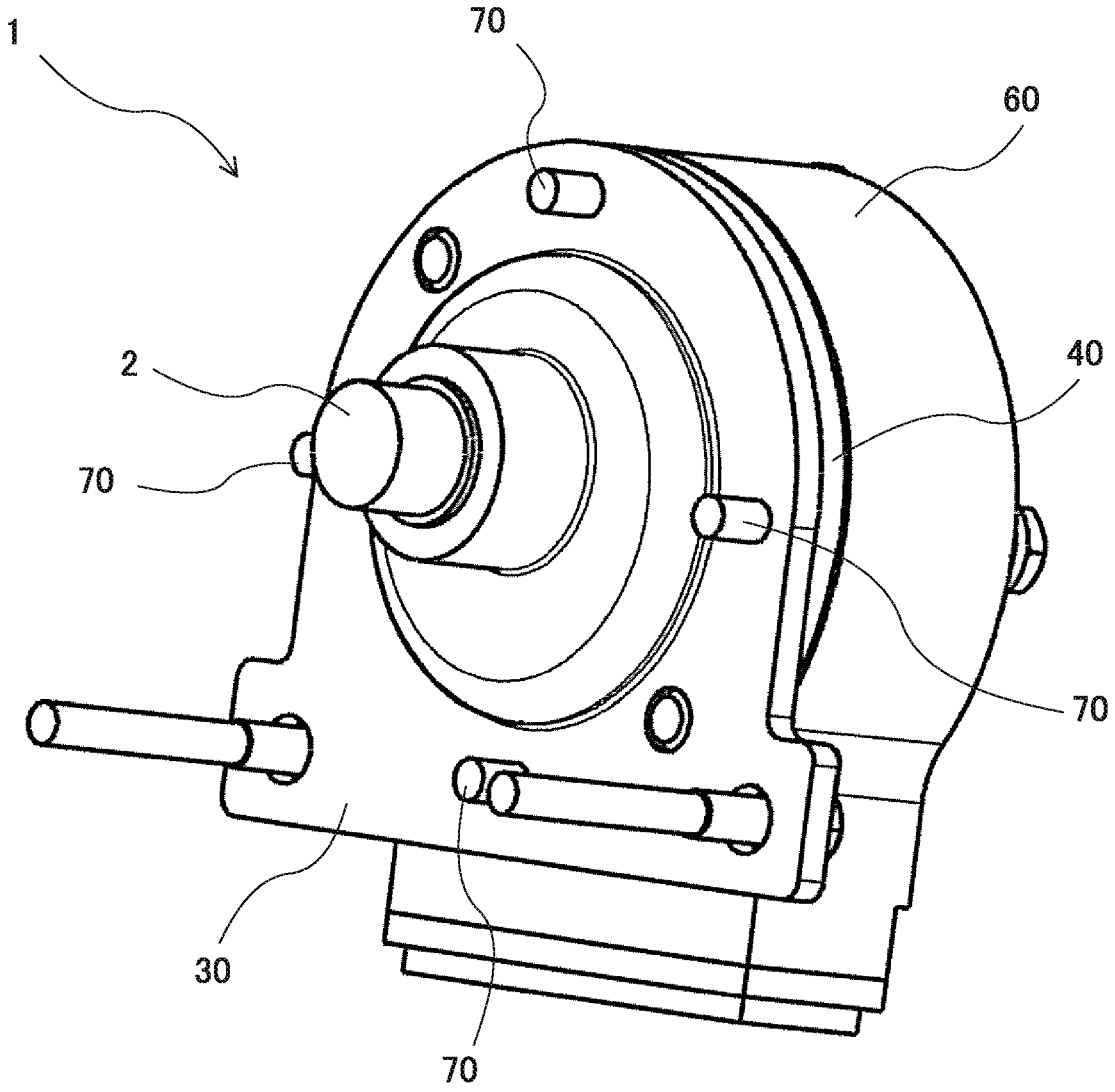
FIG. 1 is a perspective view of a gear pump according to an embodiment as seen from the front side.

A gear pump 1 according to an embodiment is a trochoid type internal gear pump that sucks a liquid such as oil and pressure-feeds the sucked liquid. The gear pump 1 is mounted, for example, on a vehicle or the like. The gear pump 1 is formed in a block shape as a whole as shown in FIG. 1.

Figure 2:
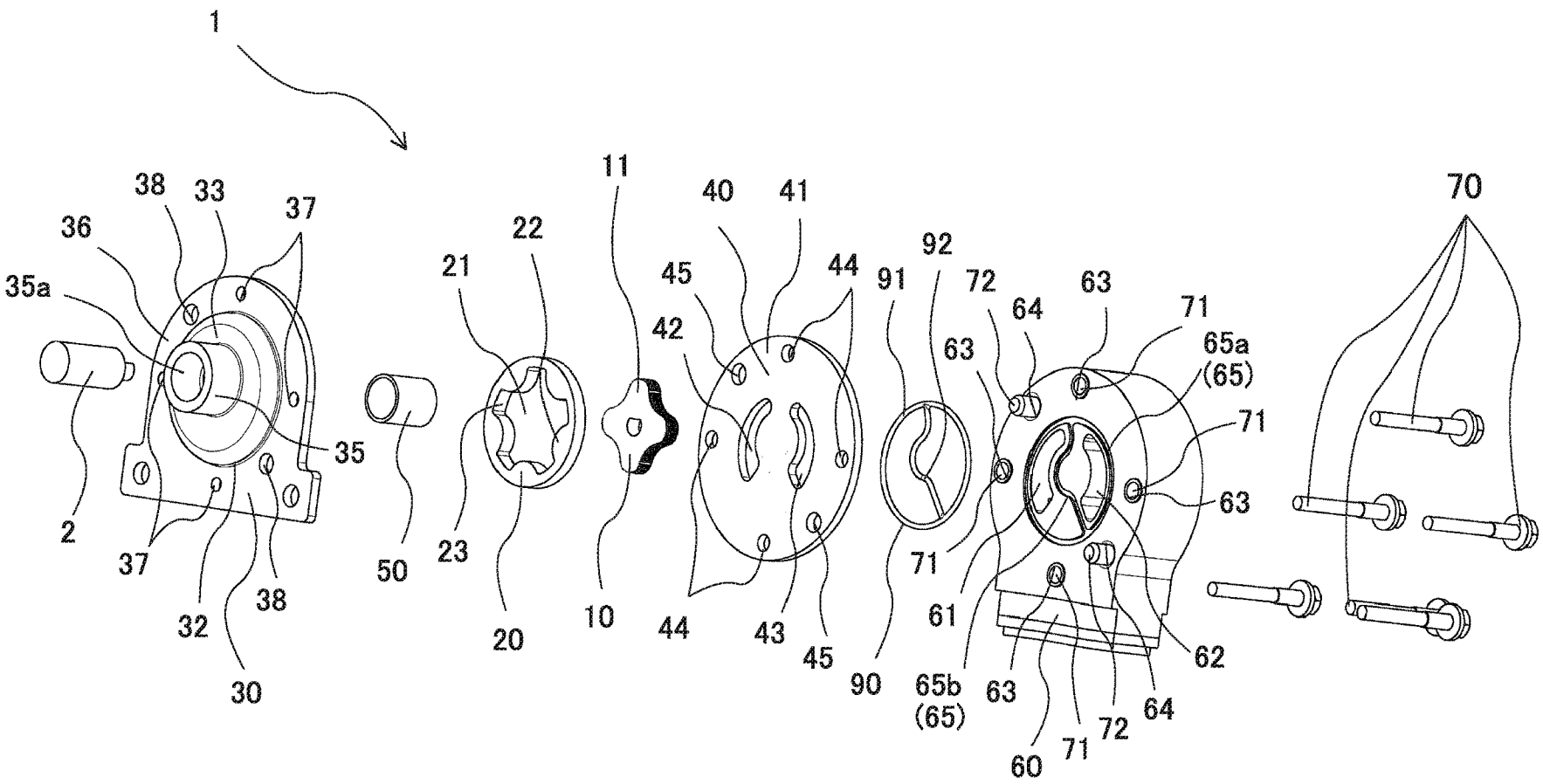
FIG. 2 is an exploded view of the gear pump according to the embodiment.
Figure 3:
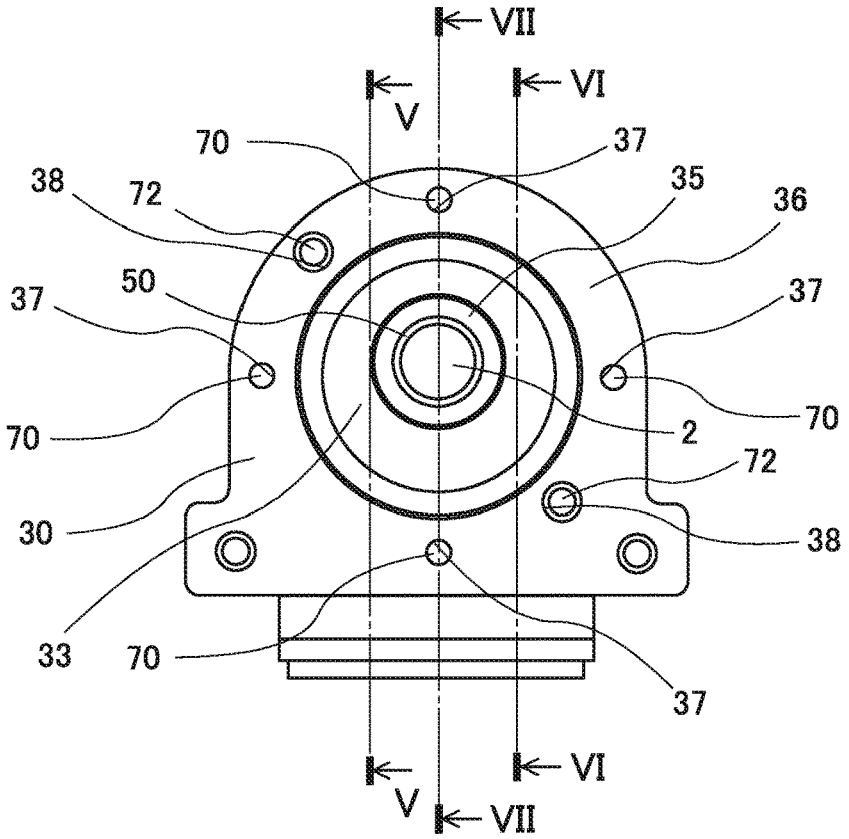
FIG. 3 is a front view of the gear pump according to the embodiment.
Figure 4:
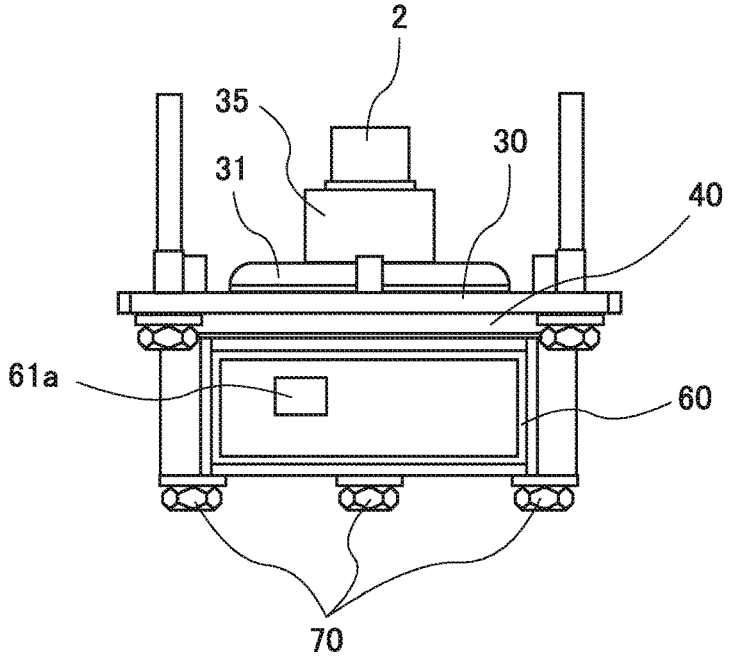
FIG. 4 is a bottom view of the gear pump according to the embodiment.
Figure 5:
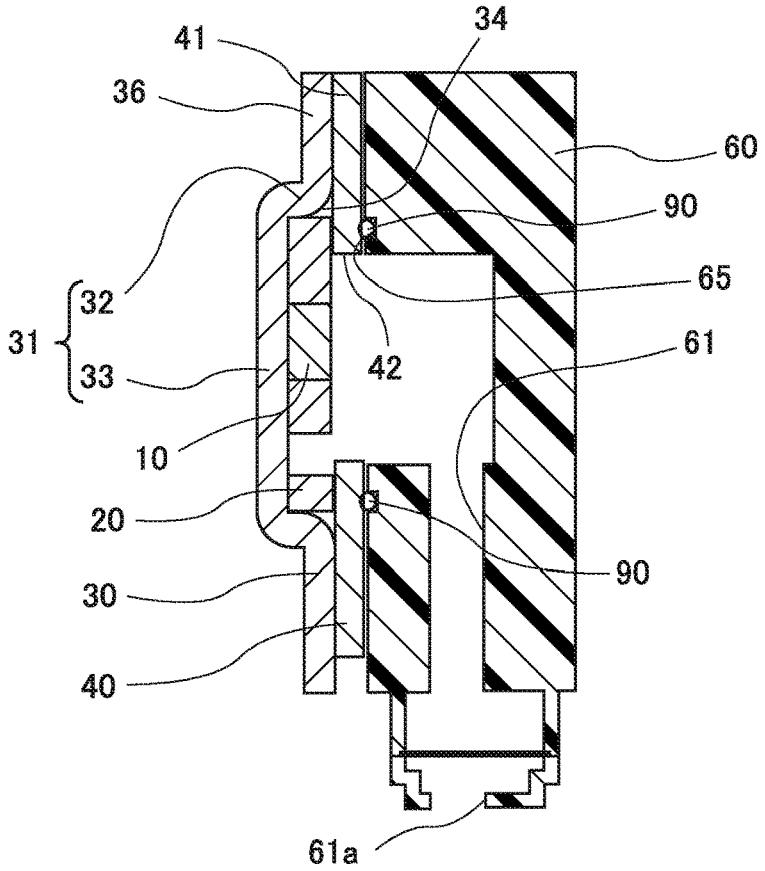
FIG. 5 is a cross-sectional view of the gear pump according to the embodiment taken along a straight line V-V shown in FIG. 3.
Figure 6:
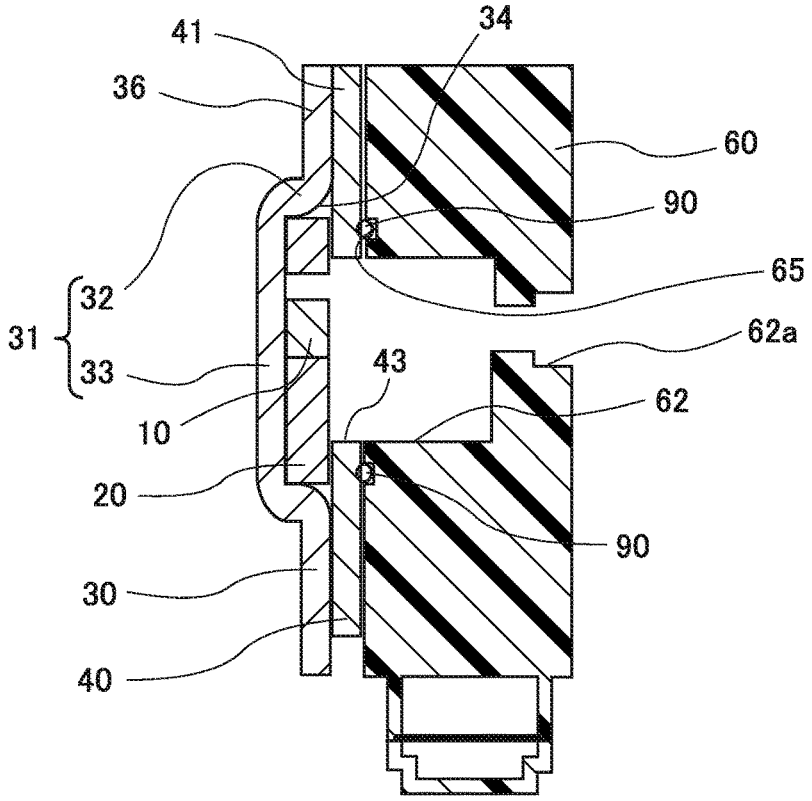
FIG. 6 is a cross-sectional view of the gear pump according to the embodiment taken along a straight line VI-VI shown in FIG. 3.

As shown in FIG. 2, the gear pump 1 includes an inner rotor 10 and an outer rotor 20. The inner rotor 10 and the outer rotor 20 form a trochoid. Each of the inner rotor 10 and the outer rotor 20 is formed from a sintered metal (for example, an iron-based metal, a copper-iron-based metal, a copper-based metal, a stainless-based metal, etc.).

The inner rotor 10 is a disc-shaped or columnar member to which a drive shaft 2 is fixed. The inner rotor 10 is mounted on the drive shaft 2 so as to be coaxial with the rotation center of the drive shaft 2. The drive shaft 2 is rotatably supported by a later-described first core 30. The drive shaft 2 extends from the first core 30 toward one side in the axial direction. A gear (not shown) is mounted on an end portion, at the one side in the axial direction, of the drive shaft 2, and a drive source (not shown) is mounted via the gear.

The inner rotor 10 rotates integrally with the drive shaft 2. The inner rotor 10 has external teeth 11. The external teeth 11 are provided on the outer circumferential surface of the inner rotor 10 at equiangular intervals. The number of the external teeth 11 of the inner rotor 10 is a predetermined number (for example, four).

The outer rotor 20 is an annular or tubular member with which the inner rotor 10 meshes. The outer rotor 20 has an inner housing portion 21 and internal teeth 22. The inner housing portion 21 forms a space that is defined by an annular tube wall 23 and open in the axial direction. The inner rotor 10 is rotatably housed in an eccentric state in the inner housing portion 21. The internal teeth 22 are provided so as to project radially inward from the inner circumferential surface of the tube wall 23. The internal teeth 22 are provided on the inner peripheral surface of the tube wall 23 at equiangular intervals. The number of the internal teeth 22 of the outer rotor 20 is a predetermined number (for example, five) that is larger than the number of the external teeth 11 of the inner rotor 10 by a predetermined number (for example, one).

The internal teeth 22 of the outer rotor 20 mesh with the external teeth 11 of the inner rotor 10. The inner rotor 10 rotates about the axis of the drive shaft 2 with rotation of the drive shaft 2 in a state where the inner rotor 10 is eccentric to the outer rotor 20 within the inner housing portion 21 of the outer rotor 20 while the external teeth 11 of the inner rotor 10 mesh with the internal teeth 22 of the outer rotor 20.

As shown in FIG. 1, FIG. 2, FIG. 3, FIG. 4, FIG. 5, FIG. 6, FIG. 7, and FIG. 8, the gear pump 1 includes the first core 30 and a second core 40. The first core 30 and the second core 40 are members that form a working chamber through which a liquid is pressure-fed from an inlet to an outlet by rotation of the inner rotor 10.

Each of the first core 30 and the second core 40 is formed from a material that is unlikely to be deformed even when a desired fastening force is applied in the axial direction at the time of fastening with a later-described housing, for example, a metal such as iron or aluminum. Each of the first core 30 and the second core 40 is a molded article formed by pressing, heading, or die casting, or a workpiece further subjected to cutting. In order to reduce the cost of the first core 30 and the second core 40, pressing is preferable. In addition, each of the first core 30 and the second core 40 may be formed from a thermosetting resin such as phenol resin instead of the metal, and further, may be a workpiece subjected to cutting.

The first core 30 is formed in a hat shape. The first core 30 has a rotor housing portion 31. The rotor housing portion 31 includes a tube wall 32 and a bottom wall 33 and forms a space in which the inner rotor 10 and the outer rotor 20 are housed. The rotor housing portion 31 is formed in a shape corresponding to the outer shape of the outer rotor 20. The tube wall 32 is formed in a tubular shape (for example, a cylindrical shape). The bottom wall 33 is formed in a plate shape (for example, a disc shape). The bottom wall 33 is provided so as to close one end in the axial direction of the tube wall 32.

Another end in the axial direction of the rotor housing portion 31 at the opposite side in the axial direction from the bottom wall 33 is open. The inner rotor 10 and the outer rotor 20 are inserted into the rotor housing portion 31 through an opening 34 at the other end side in the axial direction of the rotor housing portion 31 when being assembled to the rotor housing portion 31. The inner rotor 10 and the outer rotor 20 are housed within the rotor housing portion 31.

A shaft support portion 35 is provided on the bottom wall 33. The shaft support portion 35 is a portion that supports the drive shaft 2. The shaft support portion 35 projects from the bottom wall 33 toward an outer side in the axial direction that is the one side in the axial direction, and is formed in a tubular shape. As shown in FIG. 2, the shaft support portion 35 has an insertion hole 35*a*. The shaft support portion 35 is formed such that the inner diameter of the insertion hole 35*a* is larger than the outer diameter of the drive shaft 2. The drive shaft 2 is fixed to the inner rotor 10 within the rotor housing portion 31 in a state where the drive shaft 2 is inserted through the insertion hole 35*a* of the first core 30 and rotatably supported by the shaft support portion 35.

Figure 7:
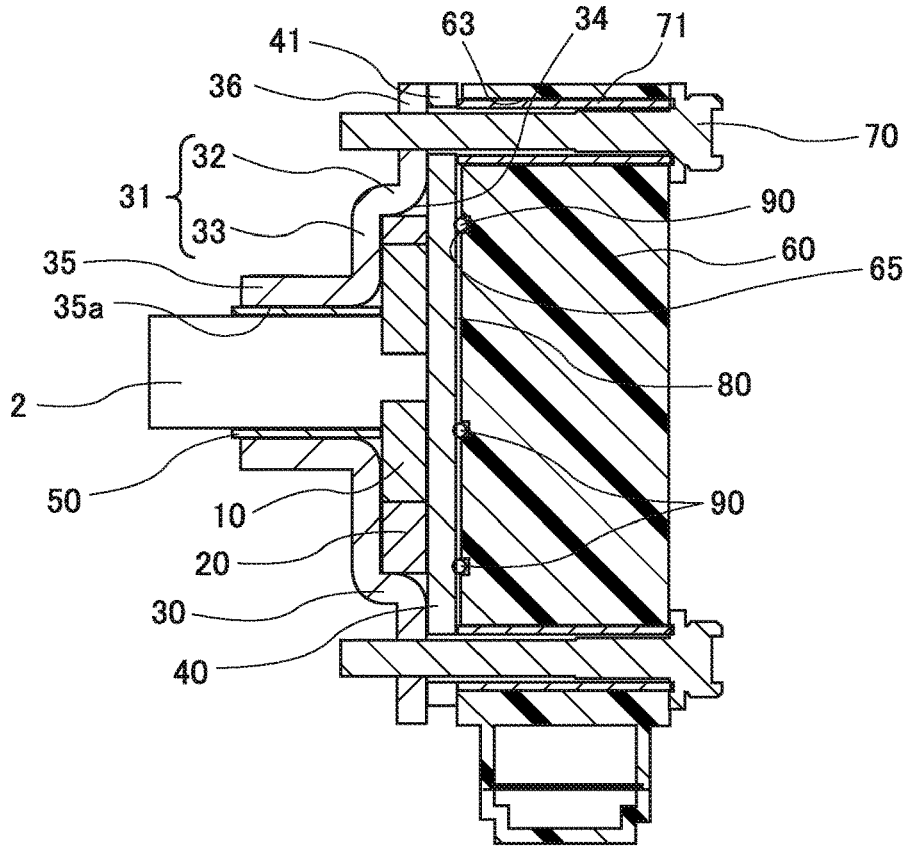
FIG. 7 is a cross-sectional view of the gear pump according to the embodiment taken along a straight line VII-VII shown in FIG. 3.
Figure 8:
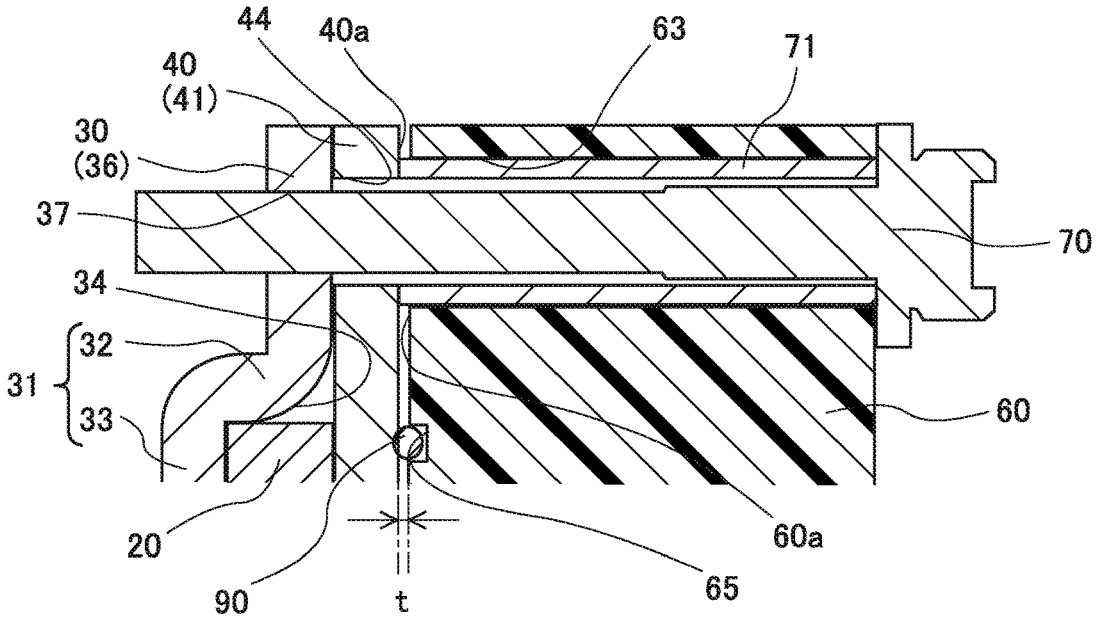
FIG. 8 is an enlarged cross-sectional view of a main part of the gear pump according to the embodiment.

As shown in FIG. 2 and FIG. 7, the gear pump 1 includes a bush 50. The bush 50 is a collar member that is interposed between the inner surface of the shaft support portion 35 of the first core 30 and the outer surface of the drive shaft 2 and fills the gap in the radial direction therebetween. The bush 50 is a slide bearing that reduces rotational sliding loss when the drive shaft 2 rotates radially inside the shaft support portion 35 of the first core 30.

The bush 50 is formed from a material that is unlikely to cause seizure during rotation of the drive shaft 2, for example, a metal such as iron-chromium steel. The bush 50 is formed in a cylindrical shape. The inner surface of the bush 50 is preferably subjected to a surface treatment with excellent slidability and wear resistance, in order to further reduce rotational sliding loss during rotation of the drive shaft 2 to extend the life of the gear pump 1.

The first core 30 also has a flange portion 36. The flange portion 36 is a portion extending radially outward from the other end portion in the axial direction of the tube wall 32 of the rotor housing portion 31. The flange portion 36 is formed in an annular shape around the opening 34 of the rotor housing portion 31. The flange portion 36 may be provided with an ear portion having a fastening hole for attaching the gear pump 1 to another component.

The second core 40 is a flat plate member formed in a board shape. The second core 40 is a member that closes the opening 34 of the rotor housing portion 31 of the first core 30. The second core 40 is disposed at the other end side in the axial direction adjacently to the first core 30. The second core 40 is positioned by coming into contact with the first core 30 in the axial direction. The second core 40 has an outer diameter larger than the size of the opening 34 of the first core 30. The second core 40 has a contact portion 41. The contact portion 41 is in contact with the flange portion 36 of the first core 30 in the axial direction.

The second core 40 has an inflow hole 42 and a discharge hole 43 each of which communicates with the working chamber surrounded by the first core 30 and the second core 40. Each of the inflow hole 42 and the discharge hole 43 is a through hole that penetrates the second core 40 in the axial direction. The inflow hole 42 is a hole for allowing a liquid stored outside to flow into the working chamber. The discharge hole 43 is a hole for discharging the liquid within the working chamber to the outside. The inflow hole 42 and the discharge hole 43 are not directly connected to each other.

Each of the inflow hole 42 and the discharge hole 43 may be formed in a crescent shape extending in the circumferential direction around the center of the outer rotor 20 as shown in FIG. 2. Alternatively, each of the inflow hole 42 and the discharge hole 43 may be formed such that the width thereof in the radial direction changes in accordance with a position in the circumferential direction.

The gear pump 1 includes a housing 60. The housing 60 is a member to which the first core 30 and the second core 40 are attached and fixed and in which a flow passage for introducing a liquid into the working chamber is formed. The housing 60 is disposed at the other end side in the axial direction adjacently to the second core 40 and is disposed so as to oppose the second core 40.

The housing 60 is formed from a material that may be deformed when a desired fastening force is applied with fastening of the first core 30 and the second core 40 by later-described bolts, for example, a resin (particularly, a thermoplastic resin). The resin for forming the housing 60 preferably has excellent creep resistance, load resistance, wear resistance, etc., and is, for example, a polyphenylene sulfide (PPS) resin, a thermoplastic polyimide resin, or the like. The housing 60 is formed by injection molding or the like.

The housing 60 has an inflow passage 61 and a discharge passage 62. The inflow passage 61 is a passage for allowing a liquid stored outside to flow through an inlet 61*a* into the working chamber. The inflow passage 61 communicates with the inflow hole 42 of the second core 40, and, together with the inflow hole 42, forms a liquid inflow passage through which the liquid flows. The inlet 61*a* is provided in a bottom wall of the housing 60. The discharge passage 62 is a passage for discharging the liquid within the working chamber through an outlet 62*a* to the outside. The discharge passage 62 communicates with the discharge hole 43 of the second core 40, and, together with the discharge hole 43, forms a liquid discharge passage through which the liquid flows. The outlet 62*a* is provided in a back wall of the housing 60.

The inflow passage 61 and the discharge passage 62 are not directly connected to each other. The liquid that has flowed through the inlet 61*a* of the housing 60 into the inflow passage 61 flows via the inflow hole 42 of the second core 40 into the working chamber, then flows via the discharge hole 43 of the second core 40 into the discharge passage 62, and is discharged through the discharge hole 43 to the outside.

Similar to the shape of the inflow hole 42, the inflow passage 61 may be formed in a crescent shape extending in the circumferential direction around the center of the outer rotor 20, or may be formed such that the width thereof in the radial direction changes in accordance with a position in the circumferential direction. In addition, similar to the shape of the discharge hole 43, the discharge passage 62 may be formed in a crescent shape extending in the circumferential direction around the center of the outer rotor 20, or may be formed such that the width thereof in the radial direction changes in accordance with a position in the circumferential direction.

The gear pump 1 includes bolts 70. The bolts 70 are fastening members that fasten the first core 30, the second core 40, and the housing 60. The bolts 70 are each formed from a material (for example, a metal such as iron or aluminum) that is unlikely to be deformed even when a desired fastening force is applied in the axial direction when fastening the first core 30, the second core 40, and the housing 60. An external thread is formed on each of axial end portions of the bolts 70. The first core 30, the second core 40, and the housing 60 have fastening holes 37, 44, and 63 into which the bolts 70 are inserted.

The fastening hole 37 is provided so as to penetrate the flange portion 36 of the first core 30 in the axial direction. The fastening hole 44 is provided so as to penetrate the second core 40 in the axial direction. The fastening hole 63 is provided so as to penetrate the housing 60 in the axial direction. Each of the fastening holes 37, 44, and 63 is provided at a plurality of locations (for example, four locations) in the circumferential direction around the axis of the drive shaft 2, and these fastening holes 37, 44, and 63, the numbers of which are equal to each other, are provided at positions corresponding to each other. Internal threads to which the bolts 70 are screwed may be formed on the inner surfaces of the fastening holes 37 of the first core 30, or may be formed on nuts as separate members.

The fastening holes 37, 44, and 63 are each formed in a circular shape. The fastening holes 37 of the first core 30 and the fastening holes 44 of the second core 40 are formed so as to have substantially the same size. Meanwhile, the fastening holes 63 of the housing 60 are formed so as to be larger in size than the fastening holes 37 of the first core 30 and larger in size than the fastening holes 44 of the second core 40. The first core 30, the second core 40, and the housing 60 are fastened by the bolts 70 being inserted into the fastening holes 37, 44, and 63 and screwed in a state where the fastening holes 37, 44, and 63 communicate with each other in the axial direction.

The gear pump 1 includes bushes 71. The bushes 71 are collar members that are interposed between the inner surfaces of the fastening holes 63 of the housing 60 and the outer surfaces of the bolts 70 and fill the gaps in the radial direction therebetween. The bushes 71 are slide bearings that reduce rotational sliding loss when the bolts 70 rotate within the fastening holes 63 of the housing 60. The bushes 71 are each formed from a material that is unlikely to be deformed even when a desired fastening force is applied in the axial direction at the time of fastening by the bolts 70, for example, a metal such as iron-chromium steel.

The bushes 71 are each formed in a cylindrical shape. The bushes 71 are formed so as to project slightly in the axial direction from the openings of the fastening holes 63 of the housing 60 in a fastened state by the bolts 70. The length by which each bush 71 projects in the axial direction from the opening of the fastening hole 63 of the housing 60 is a length corresponding to a later-described gap 80. Hereinafter, the bushes 71 are referred to as first bushes 71, and the above-described bush 50 is referred to as a second bush 50.

The first core 30, the second core 40, and the housing 60 have engagement holes 38, 45, and 64, respectively. The engagement holes 38, 45, and 64 are holes or grooves with which a common engagement pin 72 is fitted and engaged. The engagement hole 38 is provided so as to penetrate the flange portion 36 of the first core 30 in the axial direction, and provided at a position different from that of the fastening hole 37. The engagement hole 45 is provided so as to penetrate the second core 40 in the axial direction, and provided at a position different from that of the fastening hole 44. The engagement hole 64 is a groove provided on an axial end surface, opposing the second core 40, of the housing 60, and provided at a position different from that of the fastening hole 63. The engagement holes 38, 45, and 64, the numbers of which are equal to each other and are each a plural number (for example, two), are provided in the circumferential direction.

The engagement holes 38, 45, and 64 are each formed in a circular shape and are formed so as to have substantially the same size. The first core 30, the second core 40, and the housing 60 are positioned in the radial direction and the circumferential direction, for example, by the engagement pins 72, which are press-fitted and inserted into the engagement holes 64 of the housing 60, being press-fitted and inserted into the engagement holes 38 of the first core 30 and the engagement holes 45 of the second core 40.

The first core 30, the second core 40, and the housing 60 are fastened to each other by the bolts 70 being inserted through the first bushes 71, which are disposed within the fastening holes 63 of the housing 60, into the fastening holes 37 and 44 and screwed to the internal threads (not shown) in a state where the first core 30, the second core 40, and the housing 60 are positioned using the engagement pins 72 as described above.

The fastening holes 63 of the housing 60 and the first bushes 71 are formed such that the dimensions in the axial direction of the fastening holes 63 of the housing 60 are smaller than the dimensions in the axial direction of the first bushes 71 in a state where the first core 30, the second core 40, and the housing 60 are fastened by the bolts 70. That is, the dimensions in the axial direction of the fastening holes 63 of the housing 60 are smaller than the dimensions in the axial direction of the first bushes 71 in a state where the first core 30, the second core 40, and the housing 60 are fastened by the bolts 70.

If the dimensions in the axial direction of the fastening holes 63 of the housing 60 and the first bushes 71 have the above relationship, when the first core 30, the second core 40, and the housing 60 are fastened by the bolts 70, the gap 80 is formed between opposing surfaces of the second core 40 and the housing 60 in a state where the flange portion 36 of the first core 30 and the contact portion 41 of the second core 40 are in contact with each other and the housing 60 is disposed so as to oppose the second core 40. The gap 80 has a length t by which an axial end surface 40*a* of the second core 40 and an axial end surface 60*a* of the housing 60 are spaced apart from each other in the axial direction without being in contact with each other.

The gear pump 1 includes a seal member 90. The seal member 90 is a member that seals the liquid inflow passage composed of the inflow hole 42 of the second core 40 and the inflow passage 61 of the housing 60 and the liquid discharge passage composed of the discharge hole 43 of the second core 40 and the discharge passage 62 of the housing 60. The seal member 90 is disposed between the opposing surfaces of the second core 40 and the housing 60, that is, between the axial end surface 40*a* of the second core 40 and the axial end surface 60*a* of the housing 60. The seal member 90 is, for example, a rubber-like member having elasticity.

The seal member 90 is integrally formed so as to seal both the liquid inflow passage and the liquid discharge passage. The seal member 90 has an annular portion 91 and a partition portion 92. The annular portion 91 is a portion that is formed in an annular shape so as to surround the outer peripheral side of the liquid inflow passage and the outer peripheral side of the liquid discharge passage and ensures sealing from the liquid inflow passage and the liquid discharge passage to the outer side in the radial direction. The partition portion 92 is a portion that is connected to the annular portion 91 at two locations in the circumferential direction, formed in a linear shape so as to partition the liquid inflow passage and the liquid discharge passage, and ensures sealing between the liquid inflow passage and the liquid discharge passage.

The housing 60 has a recess groove 65. The recess groove 65 is a groove into which the seal member 90 is fitted. The recess groove 65 is provided on the axial end surface opposing the second core 40. The recess groove 65 has a shape corresponding to the seal member 90. That is, the recess groove 65 has an annular recess portion 65*a* and a partition recess portion 65*b*. The seal member 90 is assembled such that the annular portion 91 is fitted into the annular recess portion 65*a* and the partition portion 92 is fitted into the partition recess portion 65*b*.

The recess groove 65 has a groove width or a groove depth that is smaller than the size in which the seal member 90 is completely fitted into the recess groove 65, such that the seal member 90 projects axially outward from the opening of the recess groove 65 in a state where the seal member 90 is fitted into the recess groove 65. The seal member 90 is formed such that an amount by which the seal member 90 projects axially outward from the opening of the recess groove 65 before fastening by the bolts 70 is larger than the size of the gap 80 between the second core 40 and the housing 60.

When the first core 30, the second core 40, and the housing 60 are fastened by the bolts 70 as described above, while the gap 80 is formed between the opposing surfaces of the second core 40 and the housing 60, the seal member 90 is interposed between the axial end surface 40*a* of the second core 40 and the axial end surface 60*a* of the housing 60 and becomes elastically deformed to come into close contact with the axial end surfaces 40*a* and 60*a*. The close contact of the seal member 90 with the axial end surfaces 40*a* and 60*a* is achieved such that the outer peripheral side of the liquid inflow passage and the outer peripheral side of the liquid discharge passage are surrounded over the entire periphery in the circumferential direction without any gap therebetween and the liquid inflow passage and the liquid discharge passage are partitioned.

In the gear pump 1 having the above structure, when the drive shaft 2 rotates, the inner rotor 10, which forms the trochoid within the rotor housing portion 31 of the first core 30, rotates relative to the outer rotor 20. During the rotation of the inner rotor 10, when the internal pressure of the working chamber within the rotor housing portion 31 becomes negative due to an increase in volume of the working chamber, oil is sucked from the inlet 61*a* of the housing 60 via the inflow passage 61 and the inflow hole 42 of the second core 40 into the working chamber. Thereafter, when the internal pressure of the working chamber rises due to a decrease in volume of the working chamber caused by the rotation of the trochoid, the oil sucked into the working chamber is introduced via the discharge hole 43 of the second core 40 and the discharge passage 62 of the housing 60 to the outlet 62*a* and discharged to the outside. When this pumping action is continuously performed by the rotation of the trochoid, the oil is pressure-fed from the gear pump 1.

The gear pump 1 having the above structure is assembled according to the following procedure. Specifically, the assembling is achieved by the first core 30, the second core 40, and the housing 60 being fastened by the bolts 70 in a state where: the inner rotor 10 and the outer rotor 20 are housed in the rotor housing portion 31 of the first core 30; the contact portion 41 of the second core 40 is brought into contact with the flange portion 36 of the first core 30 such that the second core 40 closes the opening 34 of the first core 30; and the housing 60 is disposed so as to oppose the second core 40 in the axial direction.

In a state where the gear pump 1 is assembled and the first core 30, the second core 40, and the housing 60 are fastened by the bolts 70 as described above, the flange portion 36 of the first core 30, the contact portion 41 of the second core 40, the first bushes 71, and the flange portions of the bolts 70 are aligned in a state of being in contact with each other in the axial direction. Each of the first core 30, the second core 40, the first bushes 71, and the bolts 70 is formed from a material (for example, a metal) that is unlikely to be deformed even when a desired fastening force is applied at the time of fastening the first core 30, the second core 40, and the housing 60 by the bolts 70. Therefore, in the fastened state where the above contact is made, the first core 30 and the second core 40 are in contact with each other in the axial direction, and thus both cores 30 and 40 do not move relative to each other in the axial direction and are positioned relative to each other in the axial direction.

Since the above fastening by the bolts 70 is performed using the first bushes 71, tightening of the bolts 70 is accurately managed. In addition, since the above fastening by the bolts 70 is for fastening three metal components, that is, the first core 30, the second core 40, and the first bushes 71, together, each component is firmly fastened, and loosening of the fastening is prevented.

The above fastening of the first core 30, the second core 40, and the housing 60 is achieved by the bolts 70 being inserted at a plurality of locations (for example, four locations) in the circumferential direction. Thus, in the fastened state where the above contact is made, the first core 30 and the second core 40 do not move relative to each other in the radial direction and the circumferential direction and are positioned relative to each other in the radial direction and the circumferential direction.

In the above fastened state, the engagement pins 72 are inserted into the engagement holes 38 of the first core 30, the engagement holes 45 of the second core 40, and the engagement holes 64 of the housing 60, and both cores 30 and 40 are engaged through the common engagement pins 72. Thus, both cores 30 and 40 do not move relative to each other in the radial direction and the circumferential direction and are positioned relative to each other in the radial direction and the circumferential direction. Furthermore, each of the first core 30 and the second core 40 is a cut workpiece subjected to cutting. Therefore, the first core 30 and the second core 40 are positioned in the axial direction, the radial direction, and the circumferential direction with enhanced accuracy.

Moreover, in a state where the first core 30, the second core 40, and the housing 60 are fastened by the bolts 70 and the flange portion 36 of the first core 30, and the contact portion 41 of the second core 40, the first bushes 71, and the flange portions of the bolts 70 are in contact with each other in the axial direction, the gap 80 having the length t is formed between the axial end surface 40*a* of the second core 40 and the axial end surface 60*a* of the housing 60. In this structure, even when the flange portion 36 of the first core 30 and the contact portion 41 of the second core 40 are brought into contact with each other by the first core 30, the second core 40, and the housing 60 being fastened with bolts, contact between the second core 40 and the housing 60 in the axial direction is avoided.

Since the housing 60 is a member made of a resin, the housing 60 is more flexible than the first core 30, the second core 40, the first bushes 71, and the bolts 70, each of which is made of a metal, and is deformable by external force. However, the housing 60 does not come into contact with the second core 40 as described above, is not interposed between the axial end surface 40*a* of the second core 40 and the flange portions of the bolts 70, and thus does not become deformed due to the fastening by the bolts 70. Therefore, even if there is an error in the dimension in the axial direction of the housing 60, this error is prevented from affecting the fastening of the first core 30, the second core 40, and the housing 60 by the bolts 70, and the housing 60 made of a resin does not become deformed with the fastening by the bolts 70, so that the housing deformation is prevented from affecting the contact between the first core 30 and the second core 40. Accordingly, the accuracy in positioning the first core 30 and the second core 40 relative to each other is enhanced.

Meanwhile, in a state where the first core 30, the second core 40, and the housing 60 are fastened by the bolts 70, the housing 60 does not come into contact with the second core 40. Thus, the housing 60 does not need to be precisely processed. Therefore, time and effort in manufacturing are saved, and the manufacturing time is shortened.

The drive shaft 2 is rotatably supported by the shaft support portion 35 of the first core 30, and extends from the first core 30 toward the one side in the axial direction but does not extend from the first core 30 toward the other side in the axial direction where the second core 40 comes into contact with the first core 30. Therefore, a through hole through which the drive shaft 2 extends does not need to be provided in the second core 40.

The first core 30 has the rotor housing portion 31 in which the inner rotor 10 and the outer rotor 20 are housed, and is closer to the gear mounted on the end portion, at the one side in the axial direction, of the drive shaft 2 than the second core 40 is. Thus, the second core 40 does not need to be formed in a complicated shape (for example, a hat shape), and the function of the second core 40 closing the opening 34 of the rotor housing portion 31 is sufficiently performed when the second core 40 is formed in a board shape or a flat plate shape. The second core 40 is a flat plate member formed in a board shape. Therefore, the second core 40 is made flat, so that the manufacturing cost of the gear pump 1 is reduced and the gear pump 1 becomes inexpensive.

When the first core 30 and the second core 40 are positioned in the axial direction, the radial direction, and the circumferential direction relative to each other as described above, the accuracy in assembling each component when assembling the gear pump 1 is significantly improved. Therefore, variations in volume of the working chamber within the rotor housing portion 31 in which the inner rotor 10 and the outer rotor 20 are housed are reduced, whereby a stable discharge amount is ensured.

The housing 60 is a member made of a resin as described above. Therefore, the weight of the oil pump 1 is reduced as compared to that with a structure in which the housing 60 is a member made of a metal. Accordingly, in the gear pump 1, while the weight of the entire gear pump 1 is reduced by forming the housing 60 from a resin, desired accuracy in assembling each component is ensured by the positioning of the first core 30 and the second core 40 in the axial direction, the radial direction, and the circumferential direction relative to each other.

In the gear pump 1, in a state where the first core 30, the second core 40, and the housing 60 are fastened by the bolts 70, the gap 80 is formed between the second core 40 and the housing 60. Since the inflow hole 42 of the second core 40 and the inflow passage 61 of the housing 60 communicate with each other as the liquid inflow passage, and the discharge hole 43 of the second core 40 and the discharge passage 62 of the housing 60 communicate with each other as the liquid discharge passage, when the above gap 80 exists, liquid leakage may occur from the gap 80.

On the other hand, in the gear pump 1, the seal member 90 is disposed between the opposing surfaces of the second core 40 and the housing 60. After the first core 30, the second core 40, and the housing 60 are fastened by the bolts 70, the seal member 90 is interposed between the axial end surface 40*a* of the second core 40 and the axial end surface 60*a* of the housing 60 and becomes elastically deformed to come into close contact with the axial end surfaces 40*a* and 60*a*.

Therefore, in the gear pump 1, even when the gap 80 is formed between the axial end surface 40*a* of the second core 40 and the axial end surface 60*a* of the housing 60, sealing between the liquid inflow passage and the liquid discharge passage is ensured by the seal member 90. Accordingly, a liquid is inhibited from leaking from the liquid inflow passage and the liquid discharge passage through the gap 80.

Prevention of liquid leakage from the liquid inflow passage to its outer peripheral side, prevention of liquid leakage from the liquid discharge passage to its outer peripheral side, and prevention of liquid leakage between the liquid inflow passage and the liquid discharge passage are achieved by using the seal member 90 disposed between the opposing surfaces of the second core 40 and the housing 60 (that is, between the axial end surfaces 40*a* and 60*a*). In this case, since each liquid leakage prevention described above is achieved between the same members, that is, between the second core 40 and the housing 60, the assembling and the structure of the gear pump 1 are simplified as compared to those with a structure in which each liquid leakage prevention is achieved between different members. In addition, since each liquid leakage prevention described above is achieved by the seal member 90 which is a single body, the assembling and the structure of the gear pump 1 are simplified as compared to those with a structure in which the respective liquid leakage preventions are achieved by different seal members.

The second bush 50 is interposed between the inner surface of the shaft support portion 35 of the first core 30 and the outer surface of the drive shaft 2. The second bush 50 is a slide bearing that reduces rotational sliding loss during rotation of the drive shaft 2. Thus, rotational sliding loss during rotation of the drive shaft 2 is reduced by using the second bush 50.

In the above embodiment, the bolts 70 correspond to "fastening member" described in the claims, the bushes 71 correspond to "first bush" described in the claims, and the bush 50 corresponds to "second bush" described in the claims.

Meanwhile, in the above embodiment, the bolts 70 and the first bushes 71 are used for fastening the first core 30, the second core 40, and the housing 60. However, the present invention is not limited thereto, and not using the first bushes 71 is conceivable. In this modification, the number of components that form the gear pump 1 is reduced, and the assembling of the gear pump 1 is simplified.

Figure 9:
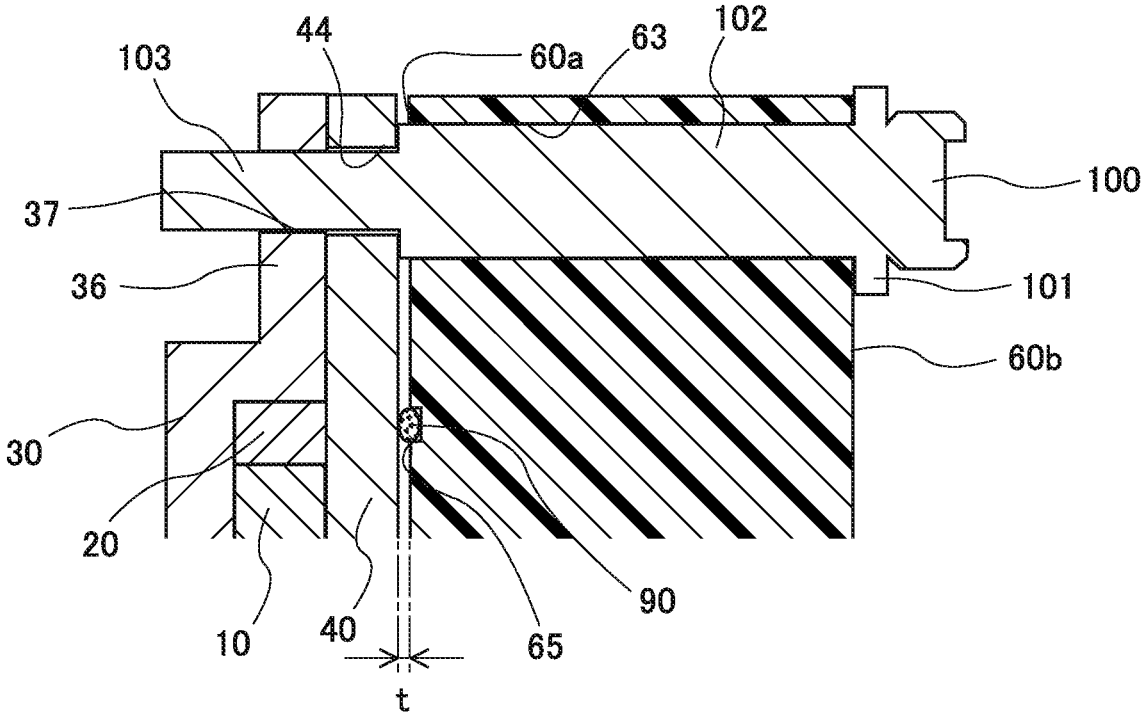
FIG. 9 is an enlarged cross-sectional view of a main part of a gear pump according to a first modification.

For example, as shown in FIG. 9, a bolt 100 having a step formed on a shaft portion thereof may be used instead of each bolt 70 having no step on a shaft portion thereof. The bolt 100 has a flange portion 101, a first shaft portion 102, and a second shaft portion 103.

The flange portion 101 is a portion that is in contact with an axial end surface 60*b* of the housing 60 at the opposite side from the axial end surface 60*a*. The first shaft portion 102 is a portion that is connected to the flange portion 101, extends in the axial direction, and is inserted into the fastening hole 63 of the housing 60. The first shaft portion 102 has an outer diameter corresponding to the inner diameter of the fastening hole 63. The dimension in the axial direction of the first shaft portion 102 is larger than the dimension in the axial direction of the fastening hole 63 of the housing 60. This dimension difference corresponds to the length t of the gap 80 between the opposing surfaces of the second core 40 and the housing 60. The second shaft portion 103 is a portion that is connected to the first shaft portion 102, extends in the axial direction, and is inserted into the fastening hole 44 of the second core 40 and the fastening hole 37 of the first core 30. The second shaft portion 103 has an outer diameter corresponding to these fastening holes 44 and 37, and has an outer diameter smaller than that of the first shaft portion 102. In the configuration of this modification as well, the same advantageous effects as those in the configuration of the above embodiment are obtained.

In the above embodiment, the second bush 50 is interposed between the inner surface of the shaft support portion 35 of the first core 30 and the outer surface of the drive shaft 2. The second bush 50 is a cylindrical member that is disposed between the inner surface of the shaft support portion 35 of the first core 30 and the outer surface of the drive shaft 2.

Figure 10:
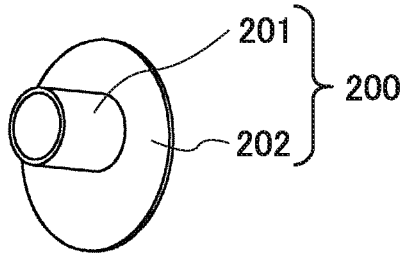
FIG. 10 is a perspective view of a bush made of a metal and included in a gear pump according to a second modification.
Figure 11:
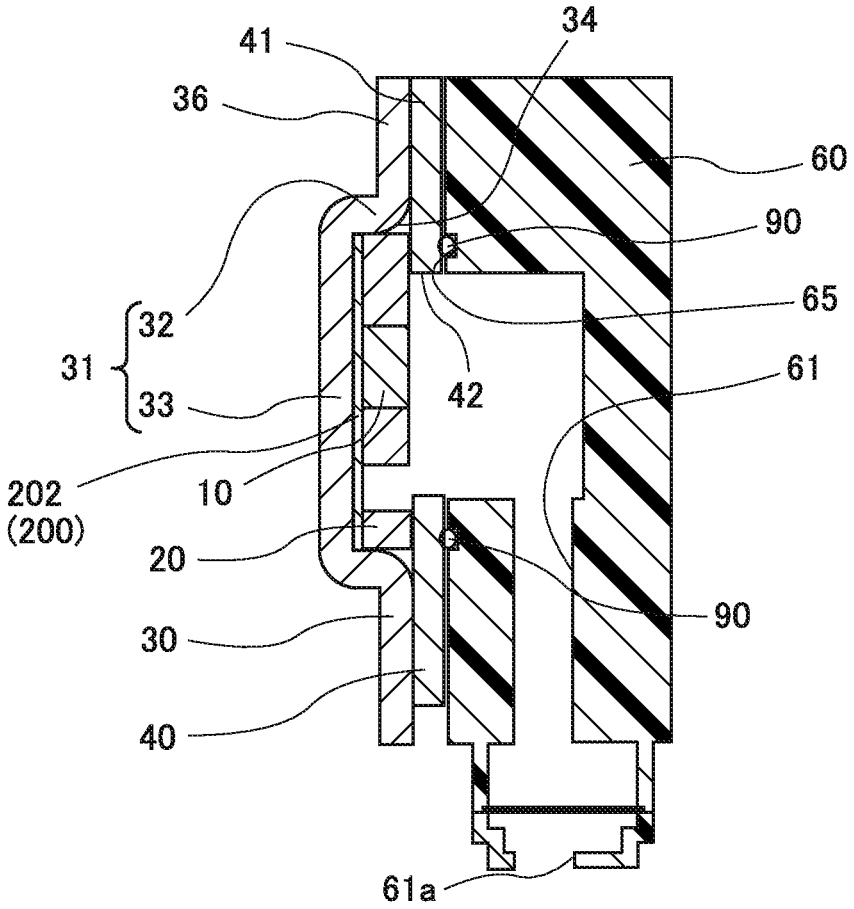
FIG. 11 is a cross-sectional view of the gear pump including the bush made of a metal and shown in FIG. 10, taken along the same straight line V-V as shown in FIG. 3.
Figure 12:
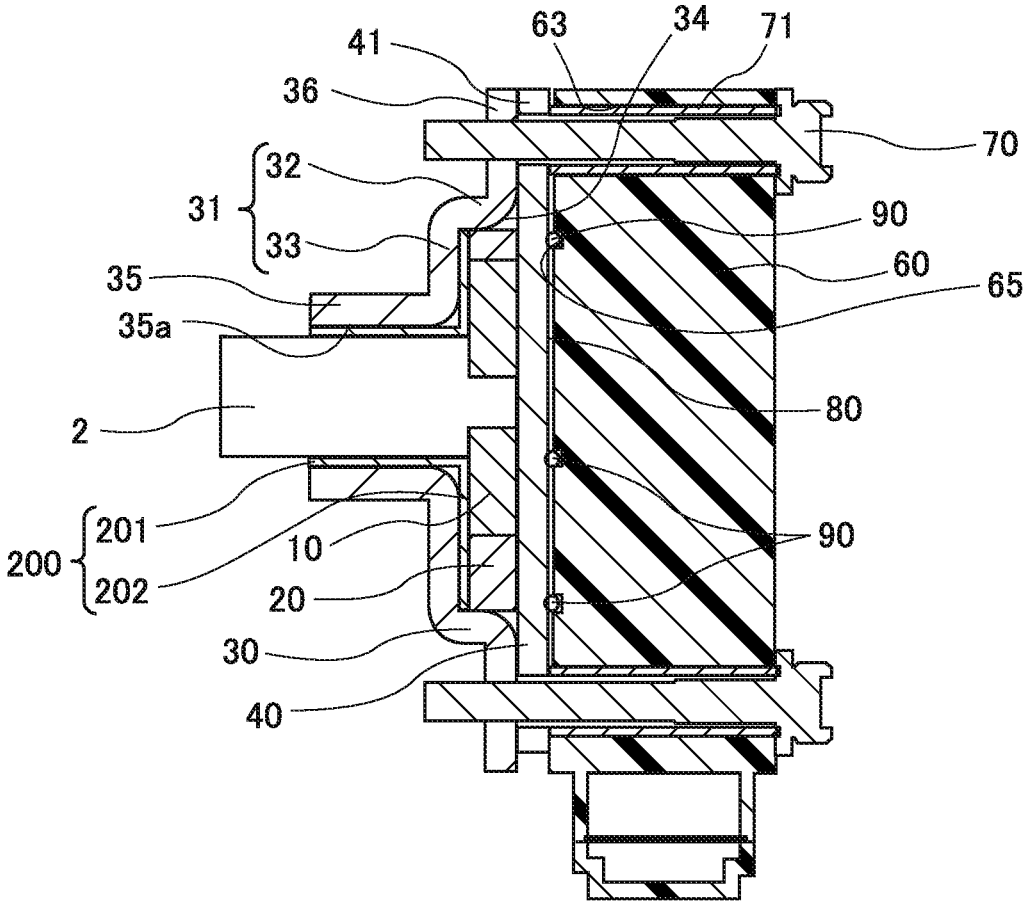
FIG. 12 is a cross-sectional view of the gear pump including the bush made of a metal and shown in FIG. 10, taken along the same straight line VII-VII as shown in FIG. 3.

However, the present invention is not limited thereto, and, as shown in FIG. 10, FIG. 11, and FIG. 12, a second bush 200 may be disposed between the inner surface of the shaft support portion 35 of the first core 30 and the outer surface of the drive shaft 2 and may have a bush tube portion 201 disposed between the inner surface of the shaft support portion 35 of the first core 30 and the outer surface of the drive shaft 2, and a bush flange portion 202 projecting radially outward from an axially inner end portion of the bush tube portion 201. The bush flange portion 202 is disposed between an axial surface of the bottom wall 33 of the rotor housing portion 31 and an axial surface of the inner rotor 10 and between the axial surface of the bottom wall 33 of the rotor housing portion 31 and an axial surface of the outer rotor 20.

In the configuration of this modification, the second bush 200 is interposed between the inner surface of the shaft support portion 35 of the first core 30 and the outer surface of the drive shaft 2, between the axial surfaces of the bottom wall 33 of the rotor housing portion 31 of the first core 30 and the inner rotor 10, and between the axial surfaces of the bottom wall 33 of the rotor housing portion 31 of the first core 30 and the outer rotor 20. Thus, rotational sliding loss during rotation of the drive shaft 2 is reduced not only between the first core 30 and the drive shaft 2 but also between the first core 30 and the inner rotor 10 and between the first core 30 and the outer rotor 20 by using the second bush 200, so that the slidability is improved.

In the above embodiment, the engagement pins 72, which are fitted into the engagement holes 38 of the first core 30, the engagement holes 45 of the second core 40, and the engagement holes 64 of the housing 60, are used for positioning the first core 30, the second core 40, and the housing 60 relative to each other when assembling the gear pump 1, and the engagement pins 72 are included in the assembled gear pump 1.

However, the present invention is not limited thereto, and the housing 60 or the first core 30 may be formed such that the engagement pins 72 are pulled out from the assembled gear pump 1. In this modification, the components required when assembling the gear pump 1 (specifically, the engagement pins 72) are removed by pulling after assembling, and thus the weight of the gear pump 1 is reduced.

In the above embodiment, the engagement holes 38, which are through holes provided in the flange portion 36 of the first core 30, the engagement holes 45, which are through holes provided in the contact portion 41 of the second core 40, the engagement holes 64, which are through holes provided in the housing 60, and the engagement pins 72, which are fitted into these engagement holes 38, 45, and 64, are used for positioning the first core 30, the second core 40, and the housing 60 relative to each other.

However, the present invention is not limited thereto, and a recess may be provided on one of the first core 30 and the second core 40 so as to be recessed in the axial direction, and a projection may be provided on the other of the first core 30 and the second core 40 so as to project in the axial direction to be fitted into the recess, or a recess may be provided on one of the second core 40 and the housing 60 so as to be recessed in the axial direction, and a projection may be provided on the other of the second core 40 and the housing 60 so as to project in the axial direction to be fitted into the recess.

The present invention is not limited to the embodiments and modifications described above, and various changes may be made without departing from the gist of the present invention.

This application claims priority on Japanese Patent Application No. 2019-177954 filed in Japan on Sep. 27, 2019, the entire contents of which are incorporated herein by reference.

The invention claimed is:

1. A gear pump comprising:

an inner rotor having external teeth;

an outer rotor having a tubular inner housing portion in which the inner rotor is rotatably housed in an eccentric state, and internal teeth that mesh with the external teeth;

a first core having a tubular rotor housing portion in which the inner rotor and the outer rotor are housed, and a flange portion projecting radially outward from a tube wall of the rotor housing portion;

a board-shaped second core having a contact portion that is in contact with the flange portion in an axial direction, and closing an opening of the rotor housing portion; and a housing disposed so as to oppose the second core and made of a resin, wherein a gap is formed between opposing surfaces of the second core and the housing in a state where the flange portion and the contact portion are in contact with each other and the housing is disposed so as to oppose the second core.

2. The gear pump according to claim 1, further comprising:

a bolt inserted into fastening holes provided in the flange portion, the contact portion, and the housing and fastening the first core, the second core, and the housing; and a first bush interposed between an inner surface of the fastening hole of the housing and an outer surface of the bolt, wherein a dimension in the axial direction of the fastening hole of the housing is smaller than a dimension in the axial direction of the first bush in a state where the first core, the second core, and the housing are fastened by the bolt.

3. The gear pump according to claim 1, wherein the inner rotor is fixed to a drive shaft, the first core has a tubular shaft support portion projecting from a bottom wall of the rotor housing portion toward an outer side in the axial direction and having an insertion hole formed therein and through which the drive shaft is inserted, and the gear pump further comprises a second bush interposed between an inner surface of the shaft support portion of the first core and an outer surface of the drive shaft.

4. The gear pump according to claim 3, wherein the second bush has a bush tube portion disposed between the inner surface of the shaft support portion of the first core and the outer surface of the drive shaft, and a bush flange portion projecting radially outward from an axially inner end portion of the bush tube portion, and the bush flange portion is disposed between an axial surface of the bottom wall of the rotor housing portion and an axial surface of the inner rotor and between the axial surface of the bottom wall of the rotor housing portion and an axial surface of the outer rotor.

5. The gear pump according to claim 1, further comprising a seal member disposed between the opposing surfaces of the second core and the housing.

6. The gear pump according to claim 5, wherein the seal member is integrally formed so as to seal both a liquid inflow passage provided in the second core and the housing and a liquid discharge passage provided in the second core and the housing.

7. The gear pump according to claim 1, wherein each of the first core and the second core is a cut workpiece formed from a metal or a thermosetting resin.

* * * * *